US010017363B2

(12) United States Patent
Iotti

(10) Patent No.: US 10,017,363 B2
(45) Date of Patent: Jul. 10, 2018

(54) TELESCOPIC ARM FOR SELF-PROPELLED OPERATING MACHINES

(71) Applicant: MANITOU ITALIA S.R.L., Castelfranco Emilia (MO) (IT)

(72) Inventor: Marco Iotti, Reggio Emilia (IT)

(73) Assignee: MANITOU ITALIA S.R.L., Castelfranco Emilia (IT)

( * ) Notice: Subject to any disclaimer, the term of this patent is extended or adjusted under 35 U.S.C. 154(b) by 0 days.

(21) Appl. No.: 15/373,140

(22) Filed: Dec. 8, 2016

(65) Prior Publication Data

US 2017/0217742 A1 Aug. 3, 2017

(30) Foreign Application Priority Data

Jan. 29, 2016 (IT) ..... 102016000009342

(51) Int. Cl.

| | |
|---|---|
| ***B66C 23/00*** | (2006.01) |
| ***B66C 23/70*** | (2006.01) |
| ***B66F 9/065*** | (2006.01) |
| ***F15B 15/16*** | (2006.01) |

(52) U.S. Cl.

CPC ..... *B66C 23/705* (2013.01); *B66C 23/701* (2013.01); *B66C 23/703* (2013.01); *B66F 9/0655* (2013.01); *F15B 15/16* (2013.01); *B66C 2700/0357* (2013.01)

(58) Field of Classification Search

CPC ... B66C 23/705; B66C 23/701; B66C 23/703; B66C 13/12; B66C 23/693; B66C 23/64; B66C 23/70; B66C 2700/0357; E04H 12/18; E04H 12/182; F16B 15/16

USPC ..... 52/115, 116

See application file for complete search history.

(56) References Cited

U.S. PATENT DOCUMENTS

| | | | | |
|---|---|---|---|---|
| 2,390,702 | A * | 12/1945 | Gail | F13B 15/16 298/22 R |
| 3,353,686 | A | 11/1967 | Cowan | |
| 4,008,648 | A * | 2/1977 | Farmer | B66F 9/08 91/168 |
| 5,850,713 | A * | 12/1998 | Hojo | B66F 3/28 212/296 |

(Continued)

FOREIGN PATENT DOCUMENTS

| | | |
|---|---|---|
| DE | 30 11 869 A1 | 10/1981 |
| EP | 0 296 047 A1 | 12/1988 |
| EP | 2 058 528 A2 | 5/2009 |

(Continued)

*Primary Examiner* — Beth A Stephan

(74) *Attorney, Agent, or Firm* — Pearne & Gordon LLP

(57) ABSTRACT

The telescopic lift arm (1) for self-propelled operating machines (10), such a lifters, telehandlers and the like, comprises three tubular elements (21, 22, 23, 24, 25, 26), having a decreasing section and telescopically connected to one another to define a support structure which is able to move between a retracted configuration in which the tubular elements (21, 22, 23, 24, 25, 26) are inserted in one another, and an elongate configuration, in which two tubular elements are extracted.

The arm (1) comprises a hydraulic actuator (4), associated to the support structure (21, 22, 23, 24, 25, 26) and provided with three hydraulic elements (41, 42, 43) telescopically connected to one another, each of which is connected to a respective tubular element of the support structure.

10 Claims, 6 Drawing Sheets

(56) References Cited

U.S. PATENT DOCUMENTS

2012/0079778 A1* 4/2012 Wasson ..... E04H 12/182
52/115

FOREIGN PATENT DOCUMENTS

| | | | | | |
|---|---|---|---|---|---|
| GB | 2167494 | A | * | 5/1986 | ..... B60N 2/0224 |
| JP | S63 20501 | U | | 2/1988 | |
| JP | H09 263389 | A | | 10/1997 | |
| JP | 2009 161272 | A | | 7/2009 | |

* cited by examiner

TELESCOPIC ARM FOR SELF-PROPELLED OPERATING MACHINES

FIELD OF THE INVENTION

The present invention relates to a telescopic arm for self-propelled operating machines such as lifters, telehandlers, lift trucks of both fixed and rotary types.

DESCRIPTION OF RELATED ART

These operating machines are used in various sectors, from construction to agriculture, to mining and so on, and are constituted by a vehicle provided with a frame mobile on tracks or wheels, which mounts the driver's cab and a lifting arm that is telescopically extensible.

A piece of equipment, or "accessory", is present at the distal end of the arm, for lifting or moving loads, which comprises a tool such as a fork, a pliers, etc.

The arm is articulated to the frame or to a rotary platform of the machine and is adapted to incline between a lower position, substantially horizontal, and an upper position in which the arm is near to the vertical; the inclination is actuated via hydraulic cylinders or the like.

The arm comprises a plurality of extending segments, having a tubular conformation and a decreasing section, which are connected telescopically.

A system of chain pulleys is known which connects the first extension to the following more internal extensions configured for obtaining a situation in which the excursion of extraction or retraction to which the first extension is subjected, on activation of a hydraulic cylinder, is also transmitted to the other extending segments A piece of operating equipment is connected to the final extending segment, such as for example forks, gripping pliers, hooks or the like.

The greater the lifting heights the arm must reach, the greater the number of extensions needed to be used, and also the greater the dimensions of the chains, in particular of the innermost chain, connected to the first extension, which must most greatly support the load.

This circumstance constitutes a limit to the height to which the known arms can carry the lifted loads, as well as a constraint on the maximum range allowed and the maximum load that can be moved.

In this context, the technical task underlying the present invention is to provide a telescopic arm which obviates the drawbacks of the prior art.

This technical task is attained by the telescopic arm realised according to claim 1.

BRIEF DESCRIPTION OF THE DRAWINGS

Further characteristics and advantages of the present invention will become more apparent from the following indicative, and hence non-limiting, description of preferred, but not exclusive, embodiments of the arm of the invention, as illustrated in the accompanying drawings, in which.

DETAILED DESCRIPTION OF PREFERRED EMBODIMENTS OF THE INVENTION

Figure 1:
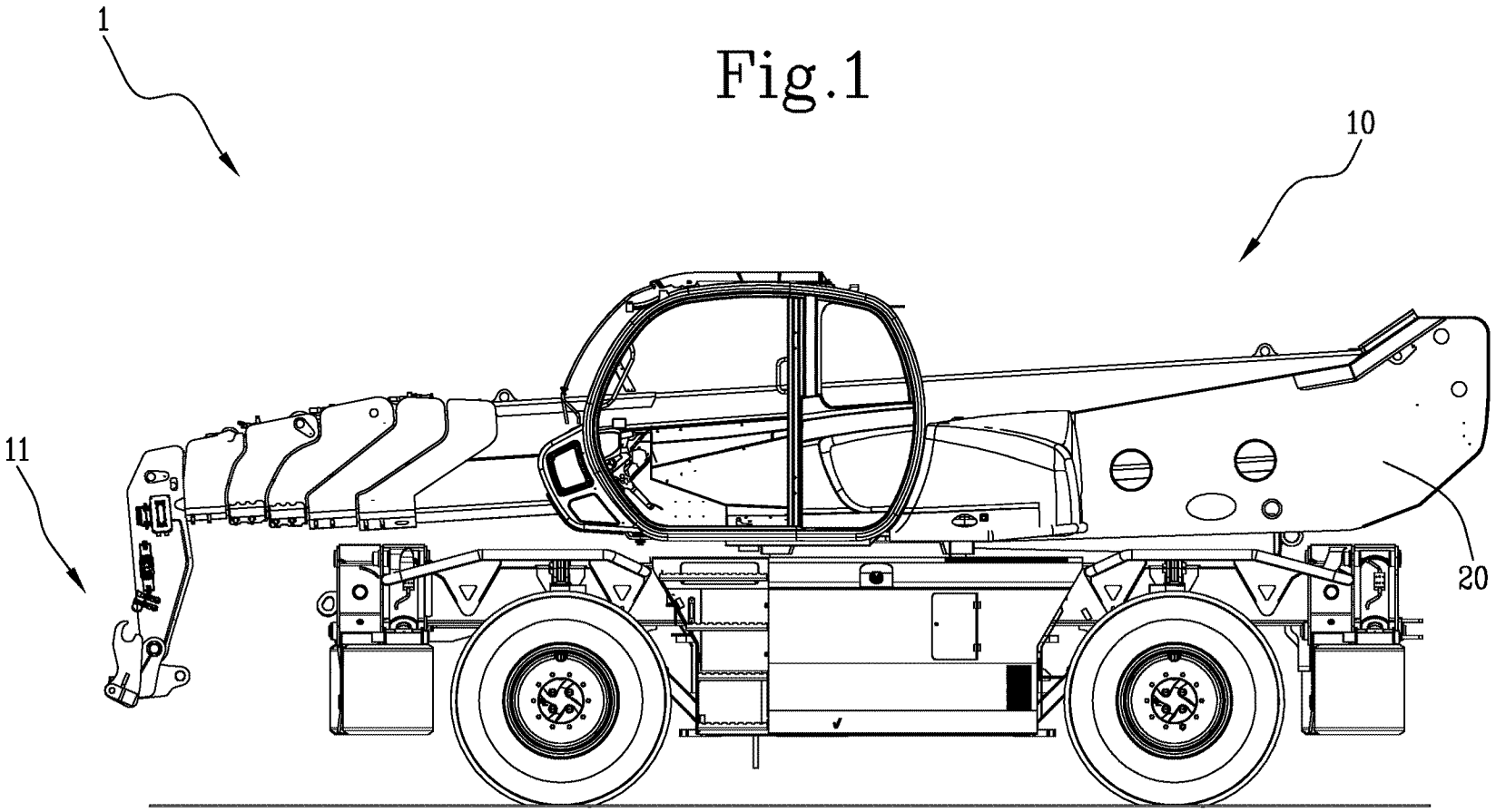
FIG. 1 is a lateral view of an operating machine which mounts the arm of the invention.
Figure 2:
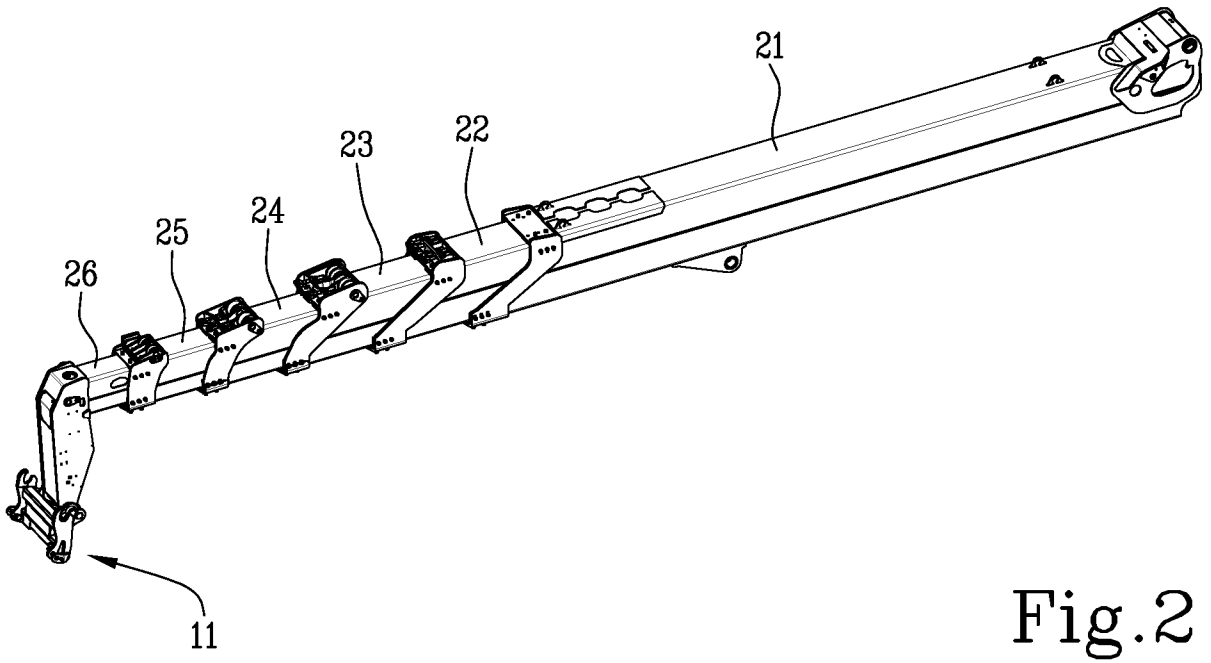
FIG. 2 is an axonometric view of the arm of the invention, in a configuration of partial extraction.

With reference to the above-mentioned figures reference numeral 1 denotes the telescopic lifting arm of the invention.

The arm 1 of the invention is destined to be mounted on self-propelled operating machines 10 such as lifters, telehandlers, lift trucks of both fixed and rotary types.

The arm 1 of the invention is predisposed to mount and support, at an end thereof, an equipment for lifting or moving loads, which can comprise a tool such as a fork, a pliers, etc.

The arm 1 can bear, at the end thereof, an attachment device 11, including of known type, which enables replacement of the equipment.

The arm 1 of the invention can be articulated to the frame or to the rotatable platform 20 of the machine 10, so as to be able to incline, on activation of a hydraulic cylinder or the like, between a lower position, substantially horizontal, and an upper position in which the arm 1 is near to the vertical.

Figure 3:
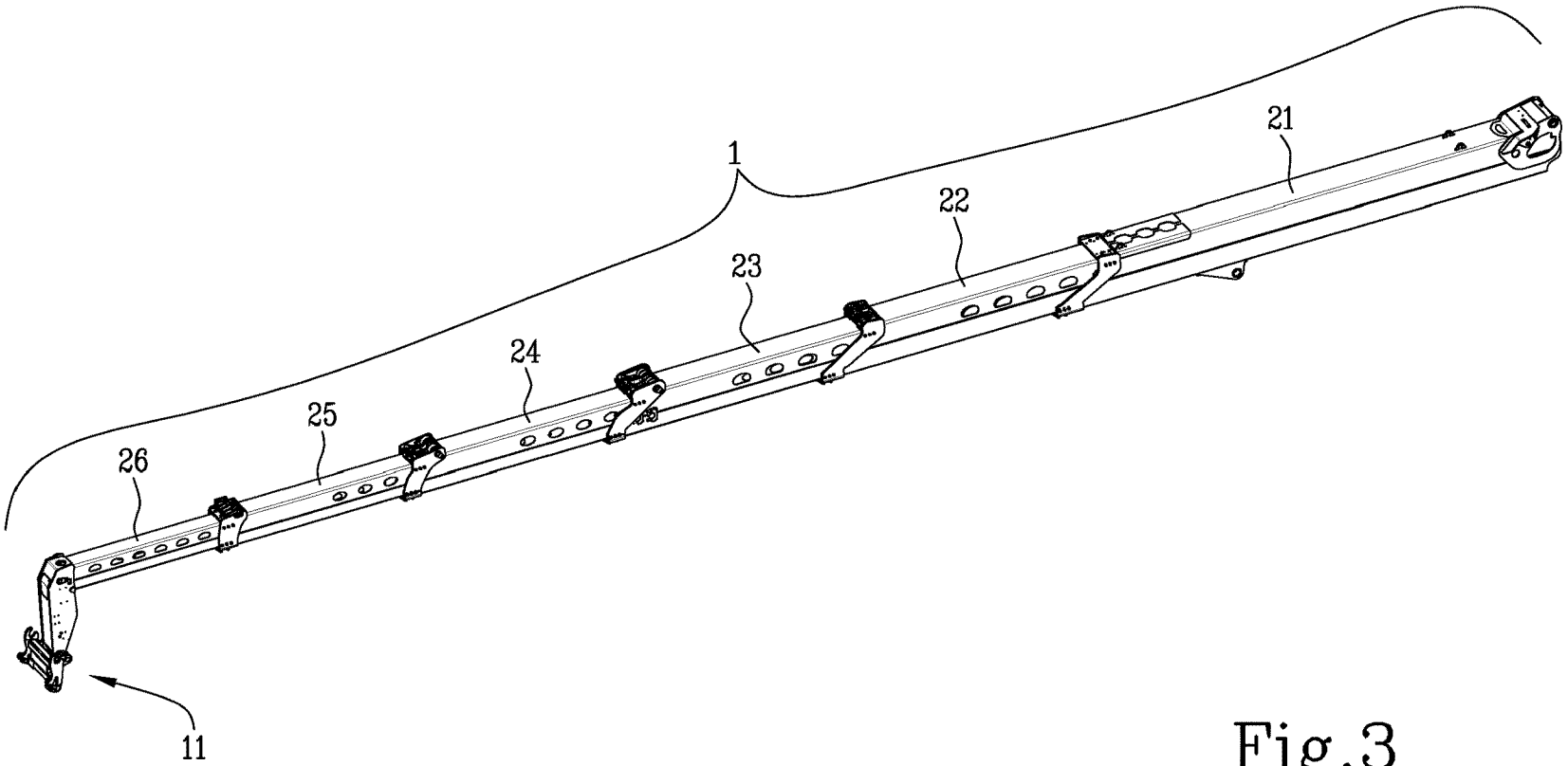
FIG. 3 is the view of the preceding figure in which the arm is completely extracted.
Figure 4:
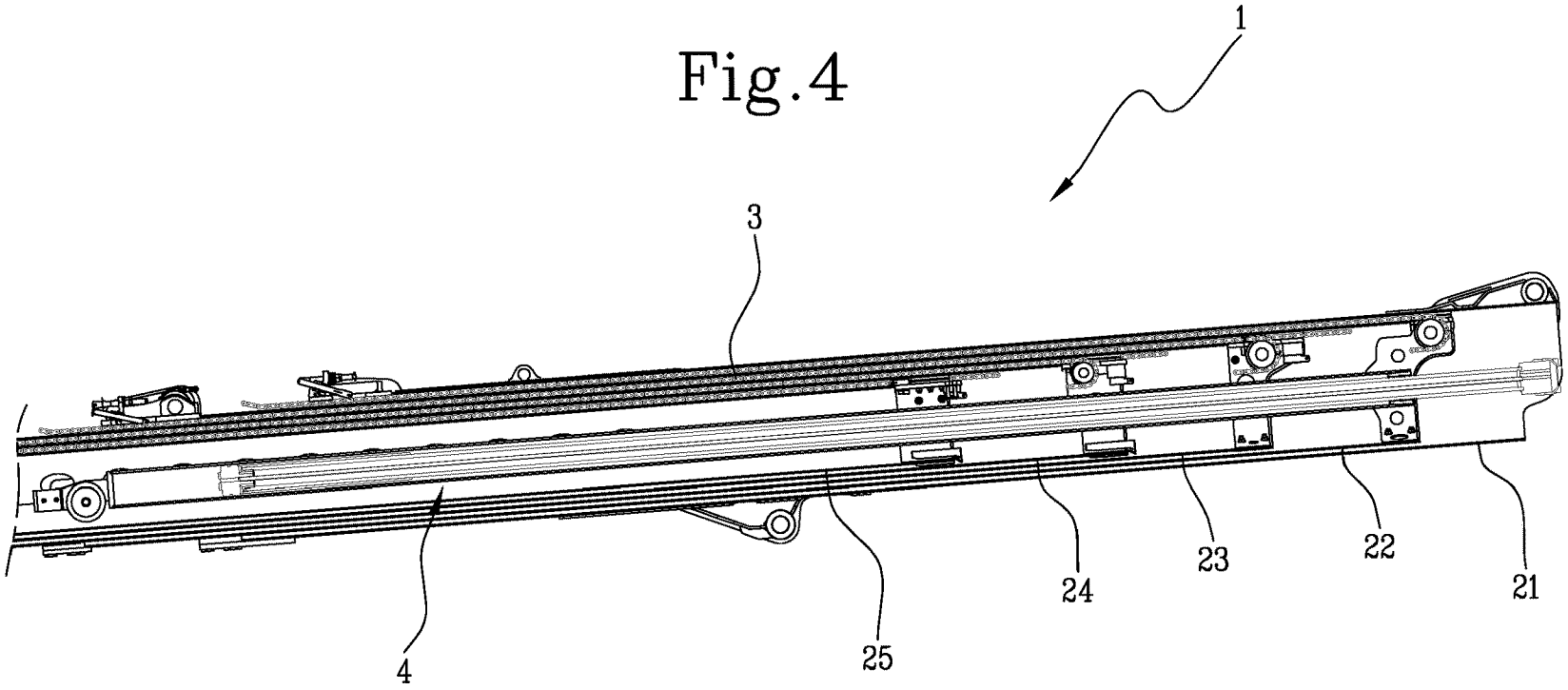
FIG. 4 is a detail in larger scale of a lateral view of a longitudinal section of the arm of the invention.

The arm 1 is extensible and retractable, and, more precisely, comprises at least three tubular elements (or "segments") 21, 22, 23, 24, 25, 26, having a decreasing section and telescopically connected to one another to define a support structure which is adapted to move between a retracted configuration (shown in FIG. 1), wherein the tubular elements 21, 22, 23, 24, 25, 26 are inserted in one another, and an elongate configuration (shown in FIG. 3), wherein at least two tubular elements are at least partially extracted and preferably totally extracted.

The tubular elements 21, 22, 23, 24, 25, 26 are preferably coaxial to one another and are able to translate along the axial direction.

In the non-limiting embodiment shown in the drawings, a proximal tubular element 21 is present, which is an outermost element destined to be directly connected to the frame or the turret 20, and five "extensions", 22, 23, 24, 25, 26, i.e. five extractable tubular elements, slidably inserted one in another.

The proximal tubular element 21 is the "fixed" element, in the sense that it does not slide, and it is the outer element; the extensions 22, 23, 24, 25, 26 slide in a longitudinal direction to the arm 1.

In any case, the arm 1 of the invention comprises three or more tubular elements, of which one can be fixed and the others can be the extensions.

Therefore, the invention includes a first extension 22, contained at least partially and extractably in the fixed segment 21 of the arm 1 and a second extension 23, contained at least partially and extractably in the first extension 22.

The invention can include a third extension 24 contained, at least partially and extractably, in the second extension 23; in the version illustrated in the figures; also a fourth and a fifth extension 25, 26 are included.

The above-described telescopic structure (in the following, "main structure", for the sake of simplicity), is able to support and raise the operating equipment and is preferably equipped for including the extension and retraction mechanisms, as well as the further operating means, such as for example the supply tubes for pressurised oil to the actuators the equipment is equipped with.

In an embodiment, the invention also comprises a transmission member 3 of the motion connecting at least two tubular elements 22, 23, 24, 25, 26 and includes one or more flexible and non-extensible linear elements (for example chains) and a plurality of pulleys on which the linear elements slide.

The member 3 is able to cause the extension/retraction of a given tubular element with respect to another, following the extension/retraction thereof.

In the embodiment in which the arm 1 comprises five extensions 22, 23, 24, 25, 26, and the chain member 3 (as it will be called, for the sake of simplicity, in the following), the chain member 3 can be connected to and act functionally on the three terminal extensions 24, 25, 26 of the main structure, which therefore comprise the final or distal segment 26 which bears the equipment 11.

A possible embodiment of the chain member 3 will be described in detail in the following, after having described further important structural characteristics of the invention.

As mentioned in the foregoing, for the sake of simplicity of explanation, an increasing ordinal number will be associated to the extensions 22, 23, 24, 25, 26, starting from the largest-section extension and progressing towards the distal extension having the smallest section; therefore the largest extension, slidably inserted in the fixed segment 21, will be the first extension 22, the further segment slidably inserted in the first extension will be the second extension 23 and so on.

The arm 1 of the invention comprises a hydraulic actuator 4, which can be contained, preferably completely, in the main structure.

The actuator is provided with at least three hydraulic elements 41, 42, 43, telescopically connected to one another, each of which is connected (preferably solidly constrained) to a respective tubular element of the main structure.

In the embodiment illustrated in the figures, the three hydraulic elements are constituted by the barrel 41 (or body) and by two extensions 42, 43 of a telescopic hydraulic cylinder, the first and the second being connected to a respective segment 21, 22, 23 of the main structure containing them.

However, embodiments of the invention are possible in which the number of stems 42, 43 is greater.

In the following, without losing in general terms, reference will be made to the particular case in which the actuator 4 is a double effect telescopic hydraulic cylinder.

In the illustrated embodiment shown in the appended drawings, two of the extensions 22, 23 of the arm 1 are subjected to the actuator 4, while the remaining extensions 24, 25, 26 are subjected to the chain member 3.

In detail, in this embodiment one of the rods 42 of the actuator is connected to the above-mentioned fixed segment 21, while the other rod 43 and the barrel 41 are respectively connected to the first 22 and the second extension 23.

In this case, the third, fourth and fifth extensions 24, 25, 26 are connected to the above-mentioned chain member 3.

In more general terms, the invention includes at least two extensions actuated by the hydraulic actuator 4.

In this way, the arm 1 of the invention can be completely without the chain member 3, entirely obviating the connected drawbacks, mentioned in the prior art.

However, for reasons connected to the dimensioning of the sections 41, 42, 43 of the actuator 4, a "mixed" embodiment can be included in which both the telescopic actuator 4 and the chain member 3 are present.

In this case, in the invention the distal extension 26 and the extension 25 housing the distal segment 26 (the "penultimate" segment) are connected to the chain member 3 while at least another two extensions are connected to a respective hydraulic element of the actuator 4.

Further, the proximal tubular element 21 (i.e. the fixed segment, in the above-described sequence) is connected to an end rod 43 of the cylinder 4, while an intermediate tubular element 23 (or "extension") is connected to the barrel 41.

Returning to a preferred version of the arm 1 of the invention, the telescopic cylinder 4 is adapted to allow an extension and retraction of the rods 42, 43 (and therefore the extensions) of a concurrent and non-sequential type.

The chain member 3 is also preferably adapted to produce an extension and a retraction of the extensions that are concurrent and non-sequential.

Figure 5:
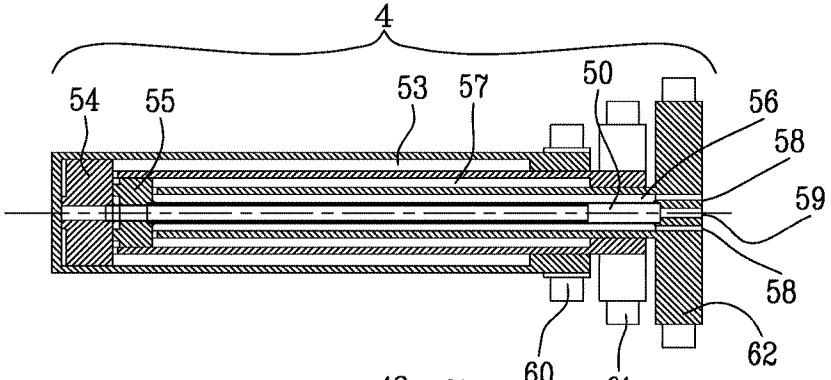
FIGS. 5, 6 and 7 are lateral views of a longitudinal section of a telescopic actuator contained in the arm of the invention, taken in different extraction configurations.
Figure 6:
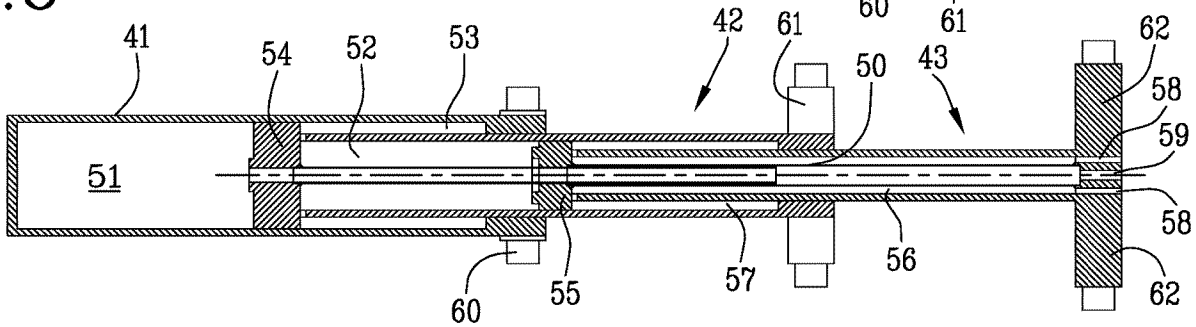
Figure 7:
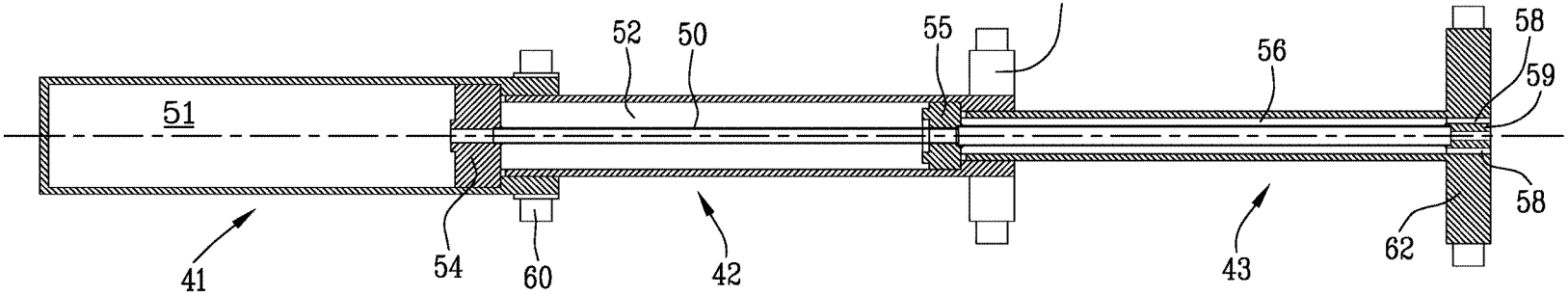

There follows a description, with the aid of FIGS. 5, 6 and 7, of preferable constructional modalities of the telescopic cylinder 4 of the invention.

The cylinder includes a barrel 41 in which a first activation chamber 51 is defined, having a variable volume, able to contain working fluid, in particular non-compressible, preferably oil.

An extensible channel 50 (for example telescopic) is arranged inside, preferably centrally, of the barrel and the rods 42, 43, for placing the first activation chamber 51 in fluid-dynamic communication with the outside, i.e. with a hydraulic distributor or in any case with a source of working fluid.

The invention also relates to a second activation chamber 52, having a variable volume, defined in the first rod 42 and a first retraction chamber 53, having a variable volume, defined between the barrel 41 and the first rod 42, communicating with the second chamber 52.

For the sake of precision, the first retraction chamber 53 can be defined between the lateral walls of the barrel 41 and of the first rod 42.

The second activation chamber 52 and the first retraction chamber 53 have preferably the same maximum volume and, also preferably, define a closed and sealed internal space.

The first activation chamber 51, the second activation chamber 52 and the first retraction chamber 53 are adapted to functionally cooperate to enable reciprocal extension/retraction of the barrel 41 and of the first rod 42, following the entering/exiting of a working fluid via said telescopic channel 50.

Note that the rods and the barrel 41 are preferably hollow elements having a substantially cylindrical shape.

The barrel 41 can have a tubular body closed by a bottom and provided with an opening in which the first rod 42 slides.

The first rod 42 can be provided with a tubular body, having a smaller diameter that the barrel 41, closed on a side by a first closing member 54 slidably constrained in the first activation chamber 51 and having dimensions that are substantially equal to the diameter thereof, so as to be adapted to sub-divide the chamber into two non-communicating internal volumes.

The second rod 43 can be similar to the first rod 42 and can therefore be slidably inserted in the first rod 42, can comprise a tubular element having a smaller diameter than the first rod 42 and be closed by a second closing member 55, slidably contained in the second activation chamber 52 and have dimensions that are substantially equal to the diameter thereof, so as to be able to sub-divide the chamber into two non-communicating internal volumes.

As mentioned in the foregoing, the second rod 43 is slidably inserted in the first rod 42 and preferably internally includes a passage chamber 56.

In this case, the invention also includes a second retraction chamber 57 defined between the first and the second rod 43 and communicating with the passage chamber 56.

The second activation chamber 52, the passage chamber 56 and the second retraction chamber 57 are able to functionally cooperate to enable reciprocal extension/retraction of the first and the second rod 43, following the entering/exiting of the working fluid via the telescopic channel 50.

In practice, when the pressurised fluid enters the first activation chamber 51, the barrel 41 slides in extension with respect to the first rod 42; this sliding pushes the working fluid initially contained in the first retraction chamber 53 externally thereof and into the second activation chamber 52.

As the second activation chamber 52 progressively fills, the first rod 42 slides in extension relative to the second rod 43 and this causes the fluid contained in the second retraction chamber 57 to flow into the passage chamber 56.

In this way, there is an extending of the cylinder 4 (compare FIGS. 5, 6 and 7).

The passage chamber 56 is in communication with the outside, like the above-mentioned central channel 50.

As the central channel 50 is at the centre of the second rod 43, the passage chamber 56 is defined between them and the body of the same second rod 43 and has communication openings 58 with the outside that are in an external position with respect to the opening 59 of the channel 50.

Therefore, when the pressurised fluid is sent into the communication opening of the central channel 50, the cylinder 4 extends and the fluid exits externally of the cylinder 4 via the passage chamber 56.

Differently, when the fluid is sent through the passage chamber 56, it flows in the above-described pathway in an inverse direction and thus a retraction of the cylinder 4 is obtained, the fluid then exiting via the central extensible channel 50.

In FIGS. 5, 6 and 7, reference numerals 60, 61 and 62 denote the fixing elements between the barrel 41 and the rods 42, 43 of the cylinder 4 and the segments of the arm 1.

In general, the fixing elements 60, 61, 62 can also be different from those represented and are designed to achieve a mechanical engagement with the relative segments; the engagement can be a friction and/or a rotatable coupling, and/or can be obtained via guides or a rigid fastening or more besides.

The foregoing, in relation to a telescopic cylinder 4 with two rods 42, 43 is also true if the number of the rods is greater; in any case, the end rod 43, i.e. the slimmest, will be the "fixed" rod, that is, solidly constrained to the fixed segment 21 of the arm 1, and will comprise the above-mentioned passage chamber 56 which is provided with the communication openings 58, 59 with the outside of the cylinder 4.

It can be understood from the above description that the invention is able to completely obviate the limits of the prior art.

In fact, consider for example the embodiment in which the arm 1 is actuated via the combination of the action of the telescopic hydraulic cylinder 4 and the chain member 3.

A telescopic arm 1 can be advantageously obtained which can extend greatly in length (and for example be provided with five or more extensions), without this involving use of chains having excessive dimensions, or a plurality of actuating devices, especially externally located to the arm 1, where they would create obstacles to correct vision of the surroundings by the operator of the machine (10).

Further, the arm 1 of the invention is able to lift loads to a greater height than the known arms, and is also able to permit a range having a greater entity (given a maximum movable load).

Consider also that, especially but not only in the case of the use of five extensions, the arm 1 of the invention enables reaching a maximum length having a greater extension than the prior art, given a same longitudinal dimension in the retracted configuration.

Some constructional and functional aspects of the chain member 3 will now be illustrated, mindful that the relative kinematic mechanism adopted by the invention can also be like those of the prior art.

Figure 8:
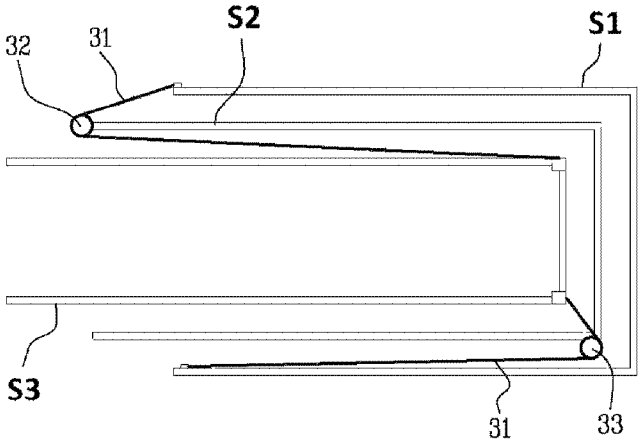
FIGS. 8 and 9 are schematic representations of the functioning of a chain member mounted on said arm.
Figure 9:
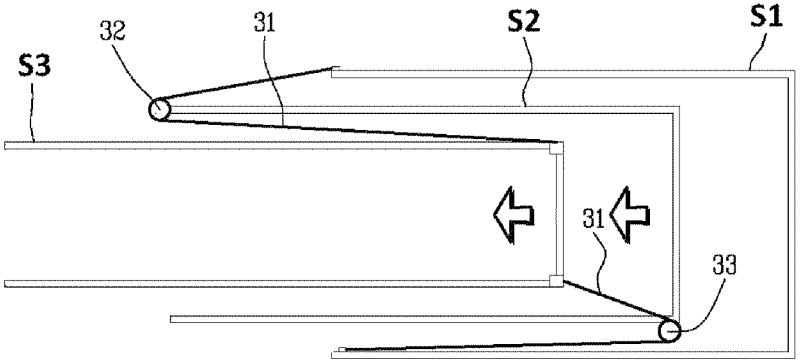

In FIGS. 7 and 8 diagrams are provided representing, in a stylised way, the components S1, S2, S3 of the arm 1 and the chain member; for reasons of simplicity of explanation, only three segments of the arm 1 are illustrated, denoted by S1, S2, S3 to take account of the fact that these are stylised elements.

The outermost segment S1, which is assumed to be fixed, for the sake of simplicity, is connected to the innermost segment S3 by means of two chains 31 which slide on a front pulley 32 and a rear pulley 33 solidly constrained to the intermediate segment S2. In detail, an end of both the chains 31 is fixed to the outermost segment S1, while the opposite end is fixed to the innermost segment S3.

When the intermediate segment S2 is extracted from the outermost segment S1, it draws with it the front pulley 32 which pushes the respective chain 31, in this way also extracting the innermost segment S3.

The retracting of the segments takes place when the intermediate segment S2 is pulled into the external segment S1; in this way the rear pulley 33 is drawn backwards and pushes on the respective chain 31 which takes the innermost segment S3 with it.

The invention claimed is:

1. A telescopic lifting arm (1) for self-propelled operating machines (10) such as lifters and telehandlers, comprising at least three four tubular elements (21, 22, 23, 24, 25, 26) with decreasing transverse cross sections and telescopically connected to one another, so as to define a support structure able to move between a retracted configuration, wherein said tubular elements (21, 22, 23, 24, 25, 26) are telescopically inserted into one another, and an elongated configuration, wherein at least two of said tubular elements are at least partially extracted, characterized in that the arm (1) comprises a hydraulic actuator (4) associated with said support structure (21, 22, 23, 24, 25, 26) and provided with at least three hydraulic elements (41, 42, 43) being telescopically connected to one another, each of said hydraulic elements (41, 42, 43) being connected to a respective one of said tubular elements of the support structure, the telescopic lifting arm further comprising a motion transmission organ (3) connecting at least two of said tubular elements and comprising one or more flexible elements and one or more pulleys whereon one of said tubular or flexible elements slides, said organ (3) being able to produce an extension or retraction of at least one of said tubular elements with respect to another one of said tubular elements.

2. The arm (1) according to claim 1, wherein said actuator (4) is contained within said support structure (21, 22, 23, 24, 25, 26).

3. The arm (1) according to claim 1, wherein one of said tubular elements comprises a proximal tubular element (21) intended to be hinged to a frame or a turret (20) of said operating machine (10), and at least two of the tubular elements comprise extractable tubular elements, a distal extractable tubular element (26) being intended to support a working equipment and being extractable and housable at least partially, within a further extractable tubular element (25), at least two extractable tubular elements (22, 23) being connected to a respective hydraulic element (41, 42) of said actuator (4).

4. The arm (1) according to claim 1, wherein said hydraulic actuator comprises a telescopic hydraulic cylinder (4) provided with a barrel (41) and at least two rods (42, 43), defined by the hydraulic elements.

5. The arm (1) according to claim 3, wherein said hydraulic actuator comprises a telescopic hydraulic cylinder (4) provided with a barrel (41) and at least two rods (42, 43), defined by the hydraulic elements, and wherein said proximal tubular element (21) is connected to one of the rods of said telescopic hydraulic cylinder (4).

6. The arm (1) according to claim 4, wherein the telescopic hydraulic cylinder (4) is suitable for allowing a non-sequential extension and retraction of the rods (42, 43).

7. The arm (1) according to claim 4, wherein said telescopic hydraulic cylinder (4) is of a double effect type.

8. The arm (1) according to claim 4, wherein the hydraulic cylinder (4) includes:

at least a first rod (42) slidably inserted within the barrel (41);

at least a first activation chamber (51) defined within the barrel (41);

at least one extensible channel (50) for putting said first activation chamber (51) into communication with an outside;

at least a second activation chamber (52) defined within the first rod (42); and at least a first retraction chamber (53) defined between the barrel (41) and the first rod (42), communicating with the second activation chamber (52);

wherein the first activation chamber (51), the second activation chamber (52) and the first retraction chamber (53) are adapted to enable reciprocal extension/retraction of the barrel (41) and of the first rod (42), upon the entering/exiting of a working fluid through said extensible channel (50).

9. The arm (1) according to claim 8, wherein the hydraulic cylinder (4) comprises:

at least a second rod (43) slidably inserted into the first rod (42);

at least one passage chamber (56) defined within the second rod (43); and at least a second retraction chamber (57) defined between the first and second rod (42, 43) and communicating with said passage chamber (56);

wherein said second activation chamber (52), the passage chamber (56) and said second retraction chamber (57) are adapted to enable reciprocal extension/retraction of the first and second rod (42, 43), upon the entering/exiting of a working fluid through said telescopic channel (50).

10. The arm (1) according to claim 8, wherein the hydraulic cylinder (4) comprises:

at least one end rod (43) slidably inserted into an intermediate rod (42) of the cylinder (4); and at least one terminal passage chamber (56) defined within the end rod (43), communicating with the outside and with at least a terminal retraction chamber (57) defined between said end rod (43) and said intermediate rod (42);

wherein said terminal passage chamber (56) and said terminal retraction chamber (57) are adapted to enable reciprocal extension/retraction of the end rod (43) and the intermediate rod (42), upon the entering/exiting of a working fluid through said extensible channel (50) and into the terminal passage chamber (56).

* * * * *